US010143294B1

(12) United States Patent
Matson et al.

(10) Patent No.: US 10,143,294 B1
(45) Date of Patent: Dec. 4, 2018

(54) MOLLE SYSTEM ATTACHMENT

(71) Applicant: Matbock, LLC, Virginia Beach, VA (US)

(72) Inventors: Sean M. Matson, Virginia Beach, VA (US); Zachary L. Steinbock, Virginia Beach, VA (US)

(73) Assignee: Matbock, LLC, Virginia Beach, VA (US)

( * ) Notice: Subject to any disclaimer, the term of this patent is extended or adjusted under 35 U.S.C. 154(b) by 0 days.

(21) Appl. No.: 15/482,397

(22) Filed: Apr. 7, 2017

(51) Int. Cl.
*A45F 5/02* (2006.01)
*A45F 3/14* (2006.01)
*A41D 1/04* (2006.01)

(52) U.S. Cl.
CPC ..... *A45F 3/14* (2013.01); *A41D 1/04* (2013.01); *A45F 5/02* (2013.01); *A45F 2003/146* (2013.01); *A45F 2200/0591* (2013.01)

(58) Field of Classification Search
CPC ..... A45F 5/02; A45F 2200/0591
See application file for complete search history.

(56) References Cited

U.S. PATENT DOCUMENTS 6,510,592 B1 * 1/2003 Hamilton ..... A44B 11/06 24/170
6,823,566 B2 * 11/2004 Coffey ..... A45C 13/20 24/579.09
7,774,864 B2 * 8/2010 Carlson ..... A41D 13/0012 2/249
8,079,503 B1 * 12/2011 Yeates ..... A45C 7/0086 224/268
8,297,562 B1 * 10/2012 Yeates ..... A45F 5/02 224/191
8,458,867 B2 * 6/2013 Rogers ..... A45F 5/02 24/3.12
8,485,405 B2 * 7/2013 Crye ..... F41A 9/65 224/251
8,523,029 B2 * 9/2013 Rogers ..... A45F 5/02 224/182
D704,293 S * 5/2014 Mullen ..... D22/108
2011/0174847 A1 * 7/2011 Crye ..... F41C 33/0236 224/243
2012/0091173 A1 * 4/2012 Crye ..... F42B 39/02 224/196
2012/0168473 A1 * 7/2012 Arajakis ..... A45F 5/00 224/250
2012/0174341 A1 * 7/2012 Rogers ..... A45F 5/02 24/3.1
2013/0047386 A1 * 2/2013 Barfoot ..... A47F 5/0006 24/580.1
2015/0182011 A1 * 7/2015 Mccrone ..... A45F 5/02 224/191
2015/0335140 A1 * 11/2015 Cole ..... A45F 5/02 24/3.7
2016/0040958 A1 * 2/2016 Alcantra ..... A41D 3/00 224/182

* cited by examiner

*Primary Examiner* — Justin Larson
(74) *Attorney, Agent, or Firm* — Middleton Reutlinger; Alexander P. Brackett

(57) ABSTRACT

The disclosure is directed to a system for securing an article to a ladder attachment system. The system includes a flexible material tab that includes a locking hook that positively secures the tab to a ladder attachment. Flexible material tabs can be provided integral to a substrate or secured to an article.

14 Claims, 8 Drawing Sheets

MOLLE SYSTEM ATTACHMENT

FIELD OF THE INVENTION

The present invention relates generally to a system for securing articles to a pack or other structure and particularly to an improved system for securing Molle compatible equipment to a vest or other suitably equipped article.

BACKGROUND OF THE INVENTION

Prior art tactical gear systems often use utilize load carrying systems that utilize module lightweight load carrying equipment technology, often referred to by the acronym "Molle" systems. These systems typically use a modular vest or frame worn by a user that includes a pouch attachment ladder system, commonly referred to as a PALS system, that permits a user to strap or secure a wide variety of tactical equipment items onto the vest or frame, thereby permitting the load systems to be modular and customizable for each particular tactical mission. PALS systems comprise a grid of horizontal and vertical ribs or material that permit gear to be fastened or strapped thereto using conventional fasteners.

Current Molle systems include pouches, sacks, and other specialized gear holders that secure individual pouches that include hook and loop fasteners, button fasteners and conventional clips that secure pouches to the vest or other PALS equipped apparatus. Many of these systems are cumbersome to use and are not easily and quickly attached and removed, which is a detriment in the field. Furthermore, some prior art systems can become easily detached when subjected to shock or impact, making them undesirable for use in the field.

Thus a need exists in the art for an attachment system for use on Molle equipment that is quickly and securely attached and readily and easily detached from a PALS equipped system, that is also easy to manufacture and resistant to weather and the elements.

SUMMARY OF THE INVENTION

The present invention is directed generally to a system for securing an article such as a pouch or accessory to a tactical vest or similar gear that uses MOLLE and/or PALS attachments systems. The invention can include a plurality of tabs that are secured to an article that readily engage PALS ladders such that the article can be quickly secured and/or removed from the vest or tactical gear.

In some embodiments the tabs are integrally formed in a flexible material substrate that is secured to the pouch or article. The tabs may further include a locking hook portion for engaging a PALS ladder and positively securing the article thereto. In yet further embodiments of the invention the tabs are laser cut into a flexible lightweight material, such as a carbon fiber material.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

Before explaining exemplary embodiments consistent with the present disclosure in detail, it is to be understood that the disclosure is not limited in its application to the details of constructions and to the arrangements set forth in the following description or illustrated in the drawings. The disclosure is capable of embodiments in addition to those described and is capable of being practiced and carried out in various ways. Also, it is to be understood that the phraseology and terminology employed herein, as well as in the abstract, are for the purpose of description and should not be regarded as limiting.

The accompanying drawings, which are incorporated and form a part of the specification illustrate exemplary but non-limiting embodiments of the disclosure, and together with the description, serve to explain the principles of the disclosure.

Those skilled in the art will appreciate that the inventive concepts and principles upon which the disclosure is based may readily be utilized as a basis for designing other structures, systems, methods, and articles of manufacture for implementing the purposes of the present disclosure. Accordingly the claims appended hereto should be construed to include such equivalent constructions without departing from the spirit and scope of the invention herein disclosed.

DETAILED DESCRIPTION OF THE PREFERRED EMBODIMENT(S)

Figure 1:
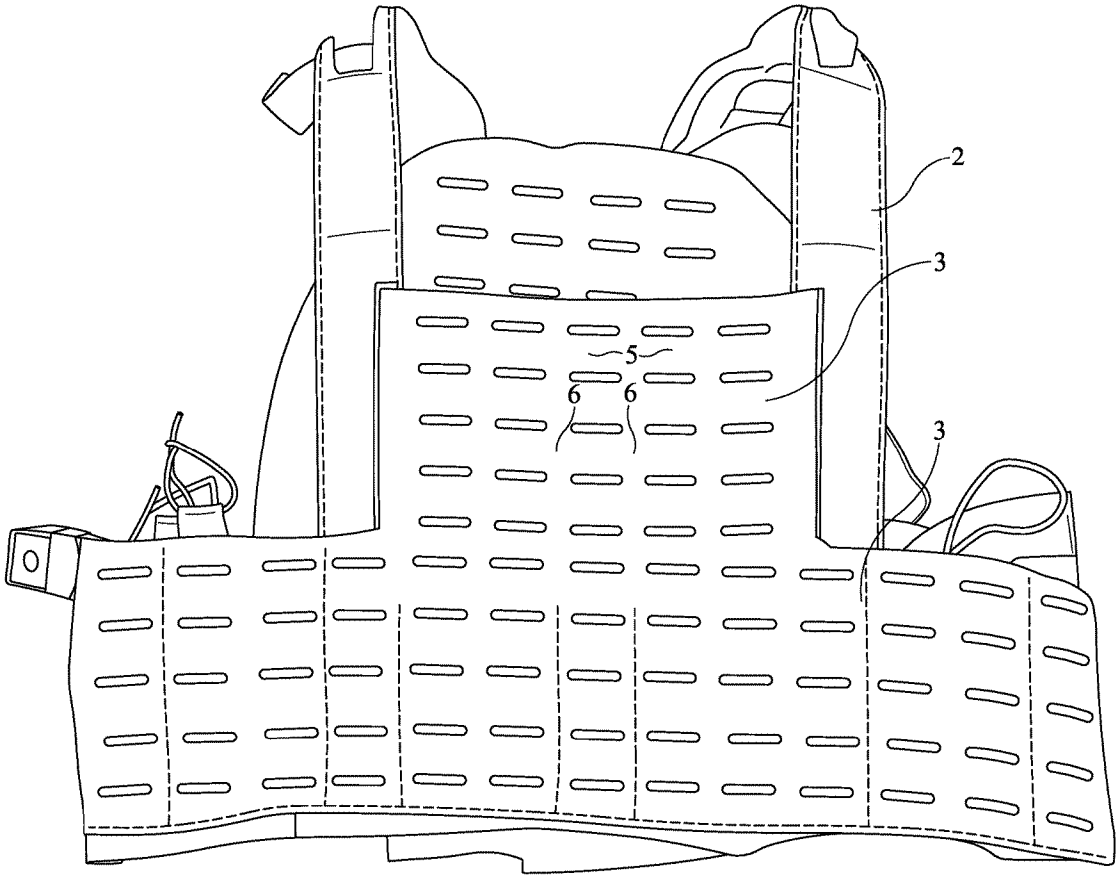
FIG. 1 is a view of a Molle vest equipped with a PALS ladder attachment system in accordance with some embodiments of the present invention.
Figure 2:
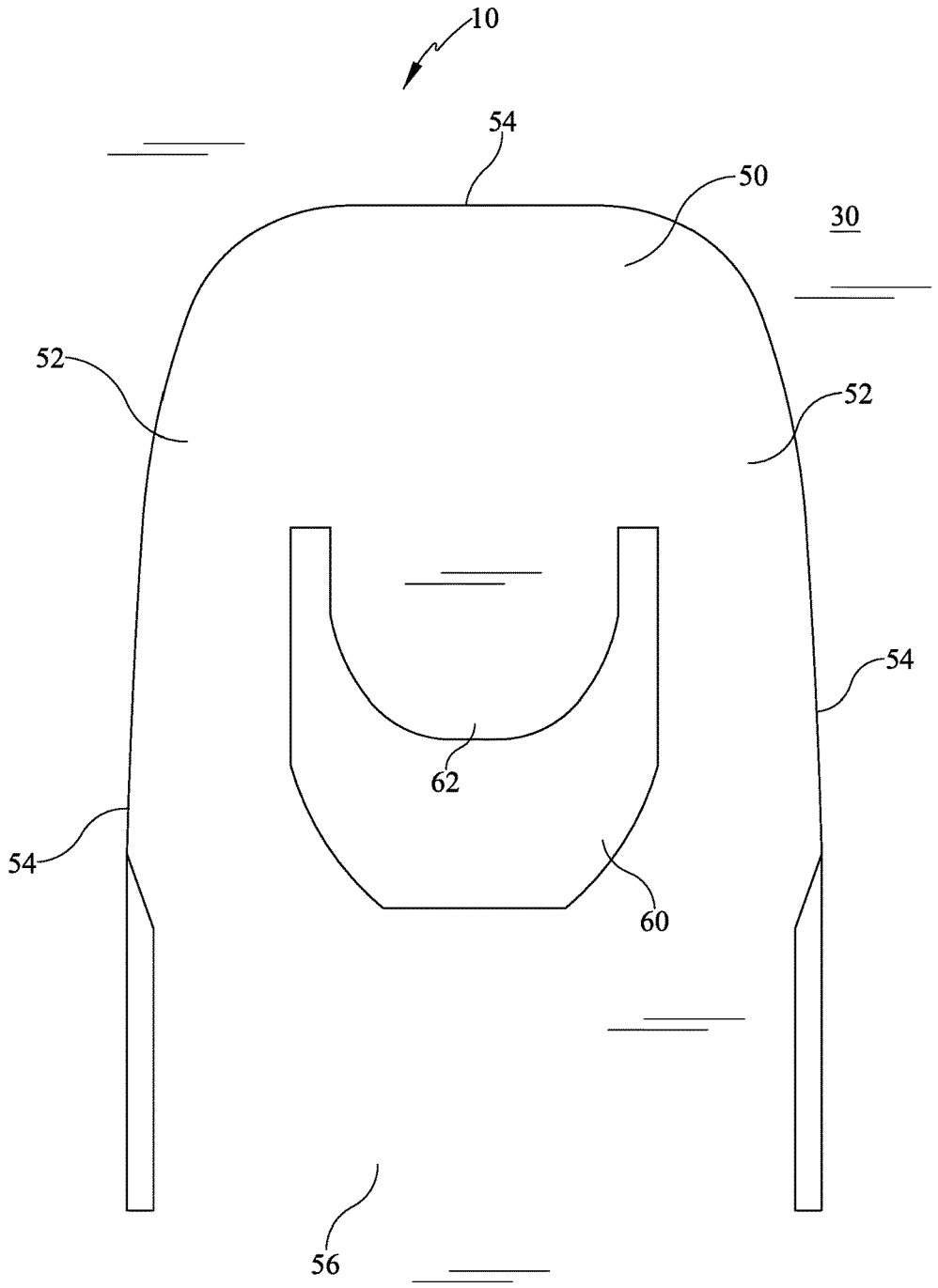
FIG. 2 is a view of a tab attachment system in accordance with some embodiments of the present invention.
Figure 3:
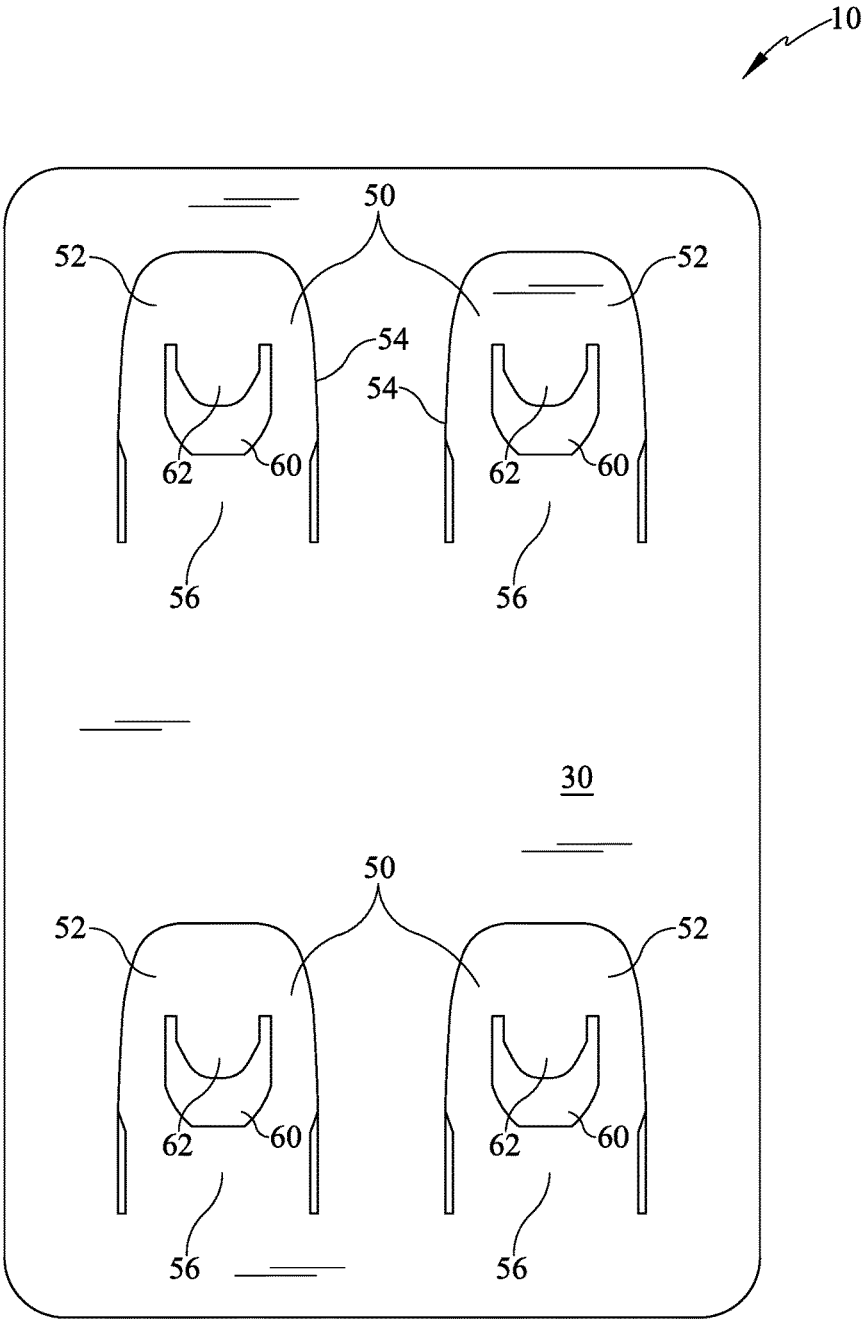
FIG. 3 is a view of a tab attachment system in accordance with some embodiments of the present invention.
Figure 6:
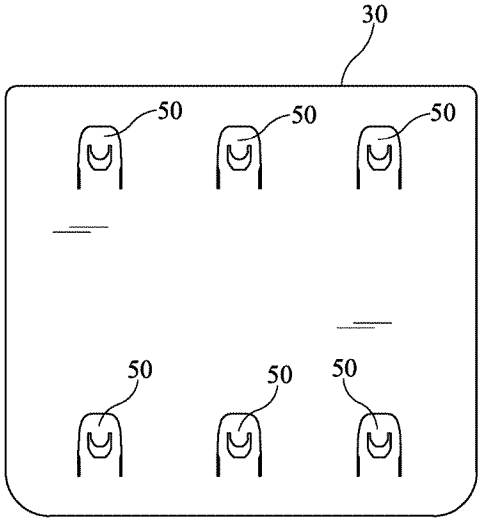
FIG. 6 is a view of a tab attachment systems in accordance with some embodiments of the present invention.
Figure 9:
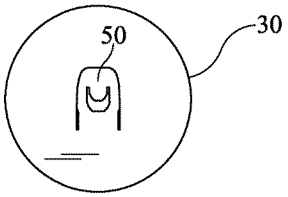
FIG. 9 is a view of a tab attachment systems in accordance with some embodiments of the present invention.
Figure 5:
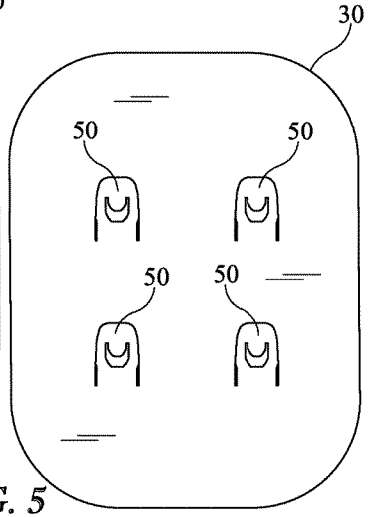
FIG. 5 is a view of a tab attachment systems in accordance with some embodiments of the present invention.
Figure 7:
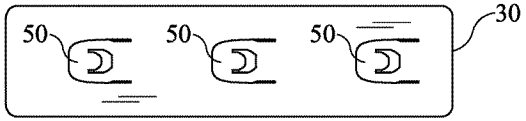
FIG. 7 is a view of a tab attachment systems in accordance with some embodiments of the present invention.
Figure 8:
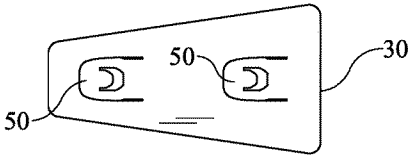
FIG. 8 is a view of a tab attachment systems in accordance with some embodiments of the present invention.
Figure 4:
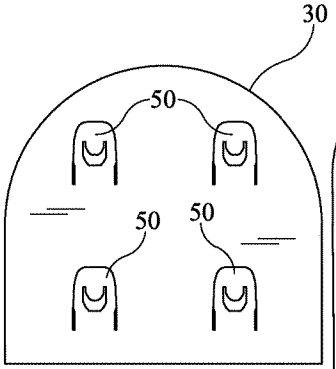
FIG. 4 is a view of a tab attachment systems in accordance with some embodiments of the present invention.
Figure 10:
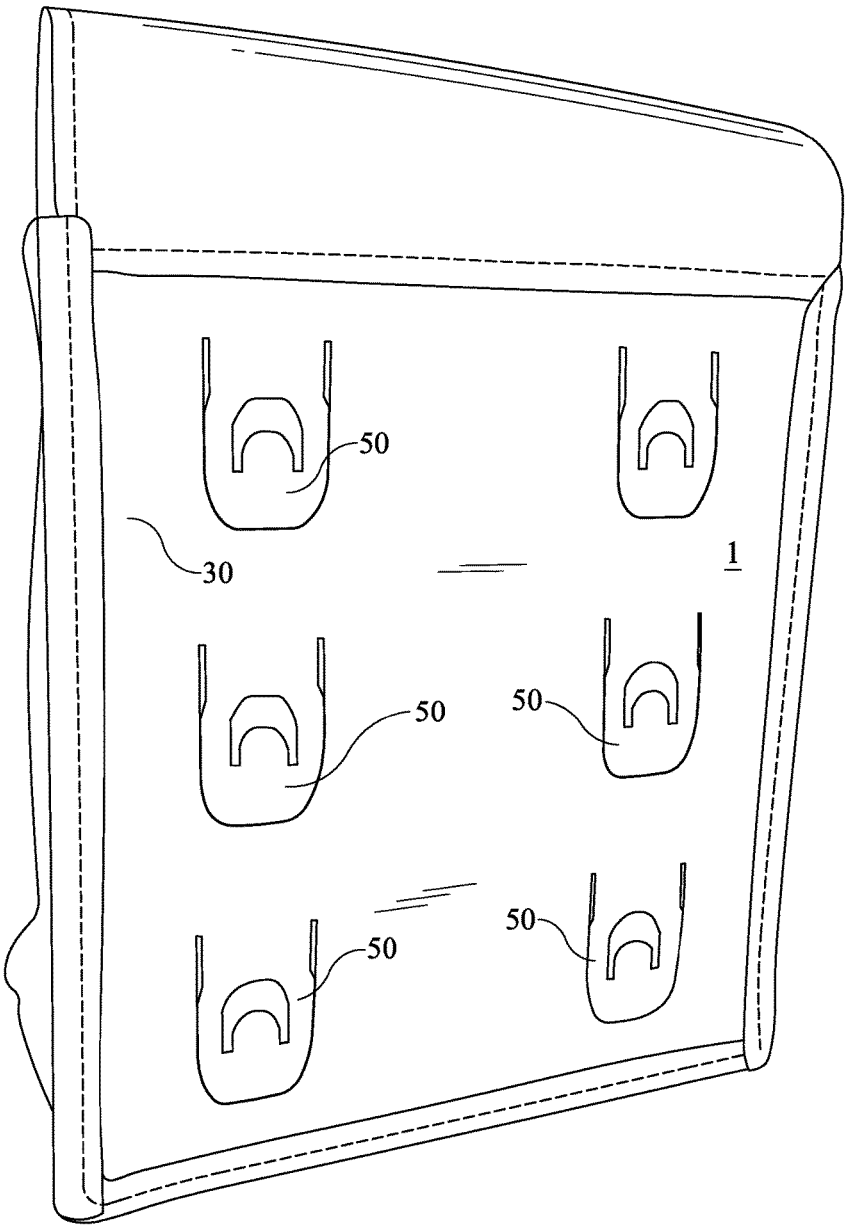
FIG. 10 is a view of a tab attachment system used on an exemplary pouch in accordance with some embodiments of the present invention.

Referring now to the drawing Figures, and in particular FIGS. 1-3, and in accordance with a constructed embodiment of the present invention an attachment system 10 for securing an article 1 to an apparatus 2 having a pouch attachment ladder (PALS) system 3, includes a substrate 30 having a plurality of tabs 50 formed therein, or secured thereto. As best seen in FIG. 1 apparatus 2, in this case a tactical vest, includes an integral PALS system 3, comprising a webbing of horizontal attachment straps 5 and intersecting vertical attachment straps 6 that are secured to or integral with each other, thus creating an attachment ladder 3 as is known in the art.

As best seen in FIGS. 2-10, substrate 30 may be shaped in various configurations and include a plurality of tabs 50 therein. Substrate 30 may further be secured to article 1, and may in some embodiments form an integral portion of article 1 such as the pouch backing portion as depicted in an exemplary but non-limiting embodiment in FIG. 10. Substrate 30 may comprise one of many lightweight flexible substrates, including carbon fiber woven material. In certain aspects of the invention, substrate 30 comprises a semi-flexible material that is capable of being cut or laser-cut to form tabs 50 therein, as will be discussed herein below. In some non-limiting embodiments, substrate 30 may comprise Tegris®, carbon fiber, semi-flexible plastics, thermoplastics, or Kydex®. Furthermore, substrate 30 may be secured to a wide variety of articles 1, such as pouches, packs, ammunition clips, tool holders and the like, without departing from the scope of the invention.

Referring again to FIGS. 2 and 3, substrate 30 includes a tab 50, or a plurality thereof, each provided to engage PALS attachment system 3. Tabs 50 comprise a body portion 52 that is flexible, or semi-flexible, and separated from substrate 30 by a cut 54 that extends around a portion of tab 50, such that body portion 52 may be flexed away from substrate 30 along a flexion area 56. In accordance with some embodiments of the invention, tab 50 body portion 52 is separated from substrate 30 by a cut 54 along a substantial portion of three sides of tab 50, although one of ordinary skill will recognize that tab 50 may be shaped in a wide variety of different configurations without departing from the scope of the invention.

In accordance with some embodiments tab 50 comprises a void portion 60 in the tab body 52, and a locking hook 62 extending from tab body 52 proximate void portion 60. In various embodiments void portion 60 may be shaped to define the shape of locking hook 62, that may extend into an area of void portion 60. Hook 62 is also semi-flexible, so that it can be flexed or moved independently from tab 50 body portion 52 and thereby engages PALS system 3 of article 1. While locking hooks 62 are depicted as having generally half-moon shapes, this shape is not intended to be limiting of the invention. One of ordinary skill will recognize that locking tabs 62 may be square, rectangular, semi-circular, triangular, or generally any shape desired to engage PALS system 3 without departing from the scope of the invention.

Additionally, while tabs 50 are depicted in certain non-limiting embodiments as cut into or formed into a substrate 30, it is to be understood that tabs 50 may be individually formed of a flexible material and secured to an article 1 at various points to secure article 1 to an apparatus 2 without departing from the scope of the present invention.

Figure 11:
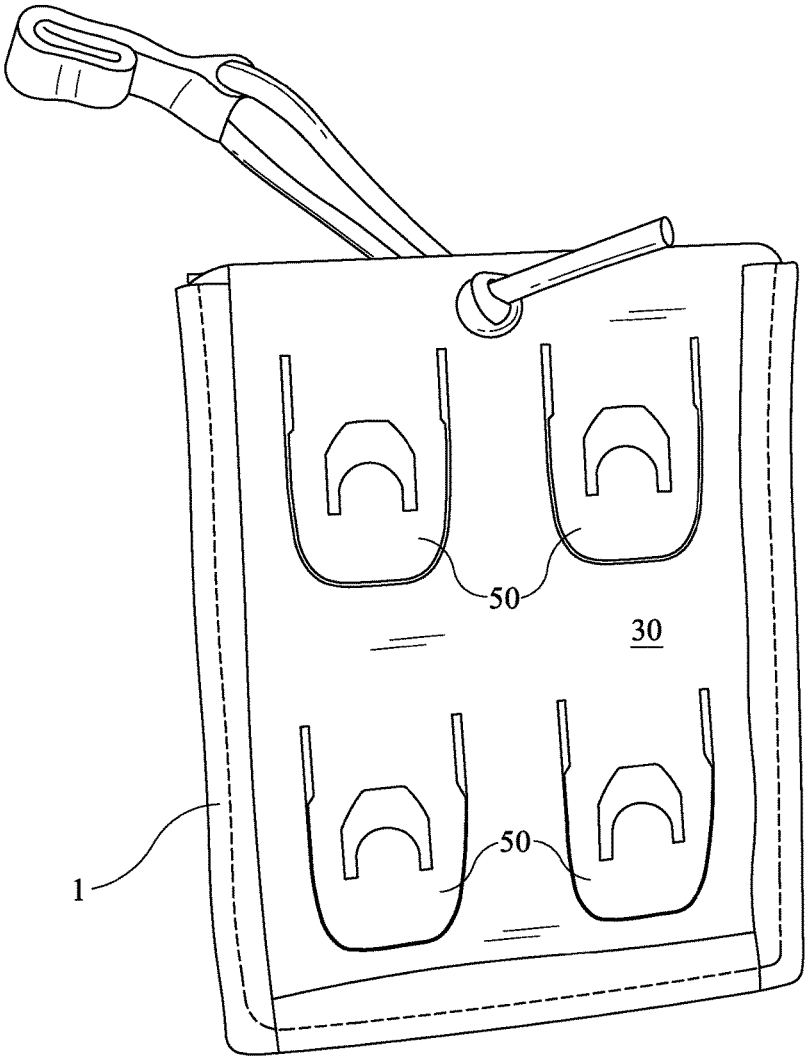
FIG. 11 is a view of a tab attachment system used on an exemplary pouch in accordance with some embodiments of the present invention.
Figure 12:
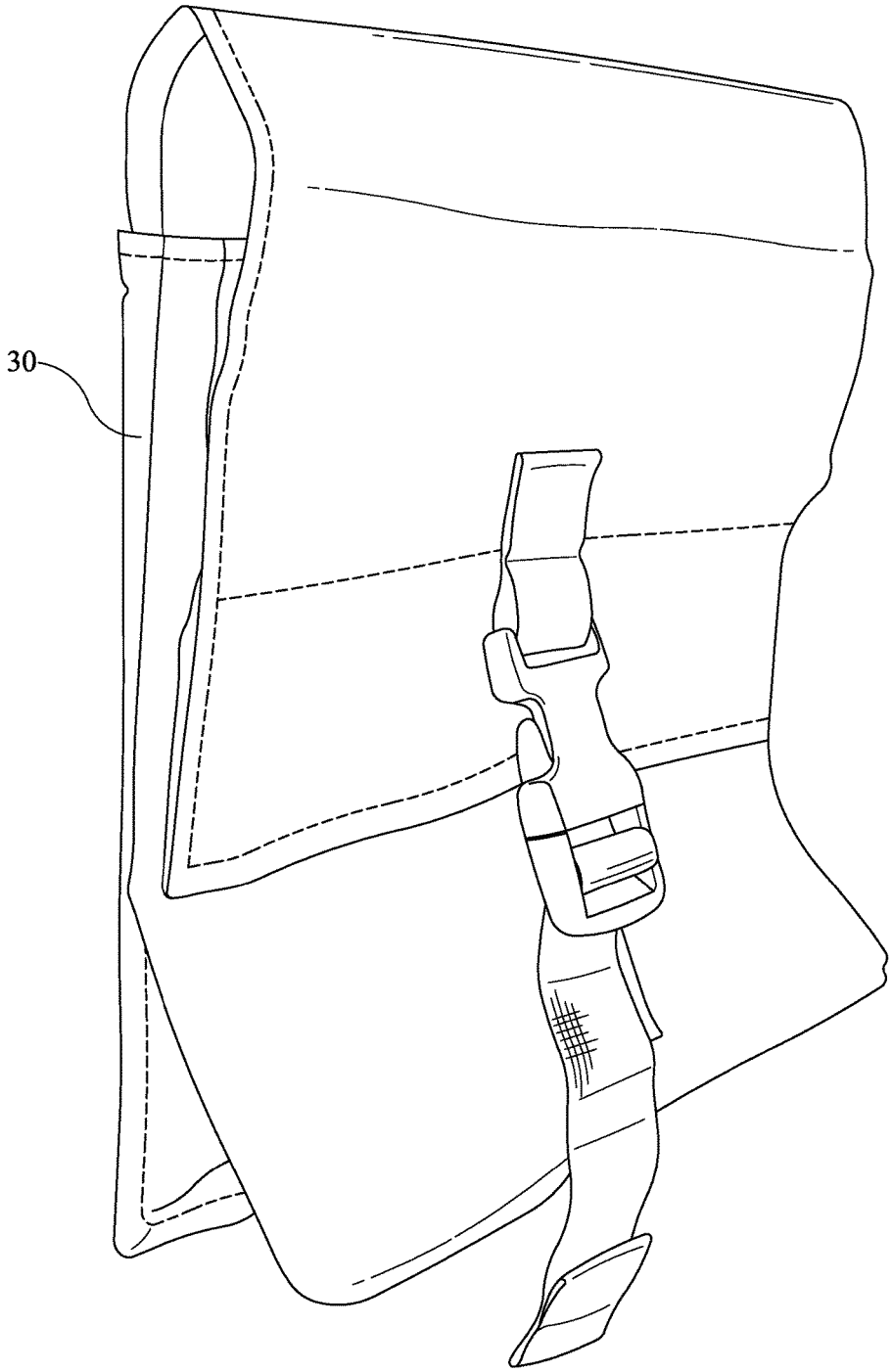
FIG. 12 is a view of a tab attachment system used on an exemplary pouch in accordance with some embodiments of the present invention.

In accordance with various aspects, and as best seen in FIGS. 3-9, substrate 30 may include a plurality of spaced tabs 50 therein, such that each tab engages a horizontal ladder or strap 5 of PALS system 3. These figures depict several exemplary arrangement of tabs 50 disposed in a substrate 30, that are designed to engage a ladder 5 for various sized pouches or accessory holders, as required by a specific gear application. Depending upon the size and weight of the article 1 to which substrate 30 is secured, a wide variety of tab 50 configurations may be employed, each tab 50 being positioned in spaced relation to the others in substrate 50 such that adjacent tabs are arranged to engage ladders 5. In an exemplary but non-limiting embodiment depicted in FIG. 10, a pouch 1 is shown having a substrate 30 with six tabs 50 therein, spaced in two columns of three tabs 50 each. In another exemplary embodiment, as depicted in FIG. 11, a substrate 30 having four tabs 50 therein is depicted.

Figure 13:
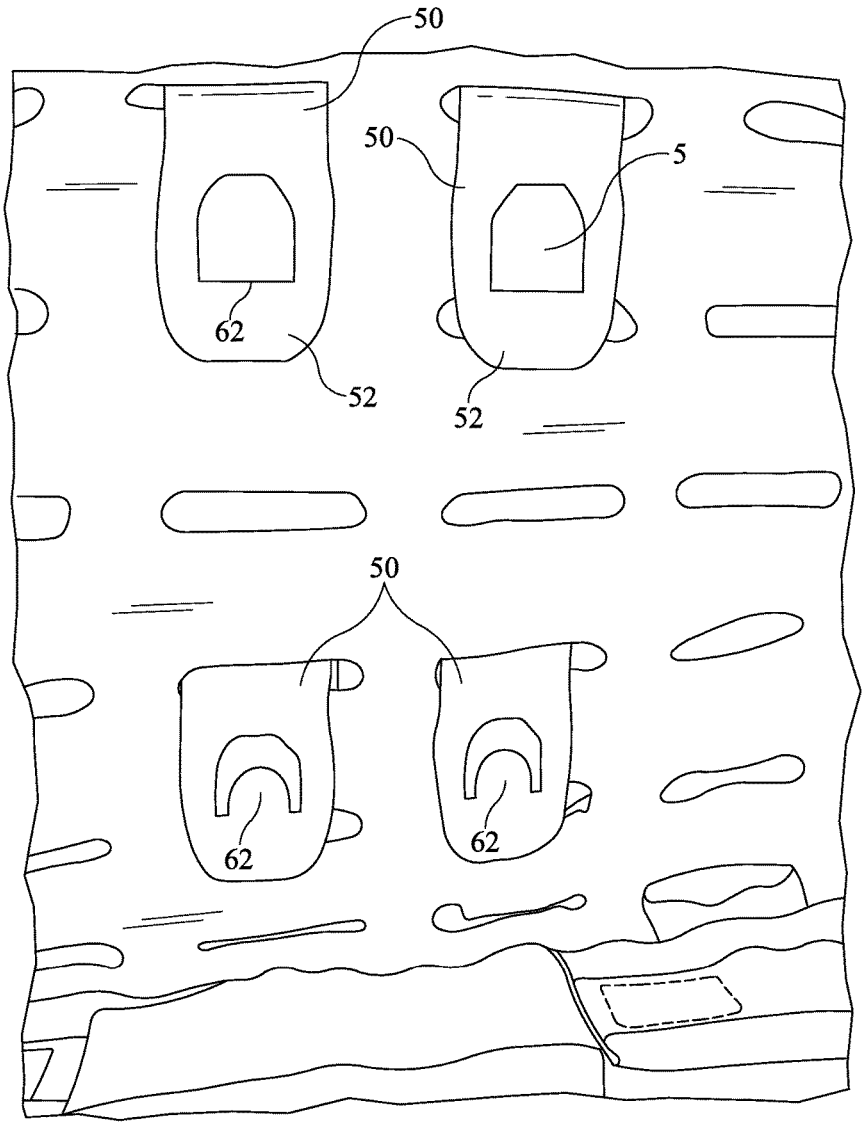
FIG. 13 is a view of a tab attachment system secured to a Molle vest.

In operation and as seen in FIG. 13, a plurality of tabs 50, in this exemplary embodiment four tabs 50, engage a PALS system 3 of a vest 2, at four separate points. The upper two tabs 50 are shown having their locking hooks 62 tucked underneath horizontal ladders 5, thereby securing substrate 50 (and thus an article 1) to vest 2. The lower two tabs 50 are shown inserted through the horizontal ladders 5, wherein locking hooks 62 are not yet tucked under and engaged with ladders 5. Thus it can be seen that an article having a plurality of tabs 50 secured thereto can be readily attached and detached from a vest 2, or other PALS equipped apparatus 2. Furthermore, once attached a vest 2, the article 1 employing the system 10 of the invention is very difficult to accidentally remove or separate from the vest 2, while remaining very easy to remove intentionally.

The foregoing detailed description of the embodiments of the invention is presented primarily for clearness of understanding and no unnecessary limitations are to be understood or implied therefrom. Modifications to the present invention in its various embodiments will become obvious to those skilled in the art upon reading this disclosure and may be made without departing from scope of the invention and the claims appended hereto.

We claim:

1. An attachment system for securing an article to a ladder attachment system equipped apparatus having a plurality of vertically spaced horizontal ladders comprising:

a substrate having at least one integral tab formed therein, each at least one tab having a semi-flexible body portion depending from said substrate along a flexion area, each tab further having a void portion in an area thereof defining a locking hook that extends into and is enclosed by said void portion for engaging said horizontal ladders.

2. The attachment system claimed in claim 1 comprising:

a plurality of tabs located in spaced relation in said substrate for engaging said horizontal ladders at a plurality of locations.

3. The attachment system claimed in claim 1 comprising:

a substrate comprising a flexible memory material.

4. The attachment system claimed in claim 3 wherein said substrate is comprised of tegris, carbon fiber, semi-flexible plastic, thermoplastic or kydex material.

5. The attachment system claimed in claim 1 wherein said substrate is secured to said article.

6. An attachment system for securing an article to a ladder attachment system equipped apparatus having a plurality of vertically spaced horizontal ladders comprising:

a semi-flexible substrate having a plurality of integral tabs formed therein, each of said tabs having a flexible portion integral to said substrate that permits said tab to bend away from said substrate, and;

a hook portion formed in and enclosed by said flexible portion of said tab for engaging said vertically spaced horizontal ladders.

7. The attachment system of claim 6 wherein said tabs are generally rectangular or semi-circular in shape.

8. The attachment system of claim 6 wherein said substrate is secured to said article.

9. An attachment system for securing an article to a ladder attachment system equipped apparatus having a plurality of vertically spaced horizontal ladders comprising:

a semi-rigid substrate having an integral tab formed therein, said tab having a semi-flexible body portion separated from said substrate along a perimeter portion and attached to said substrate in a flexion area, each tab having a cut therein defining a locking hook enclosed by said flexible body portion that can be flexed away from said tab for engaging said horizontal ladders.

10. The attachment system of claim 9 comprising:

a plurality of tabs that are generally rectangular in shape.

11. The attachment system of claim 9 comprising:

a plurality of tabs that are generally semi-circular in shape.

12. The attachment system of claim 9 comprising:

an accessory secured to said substrate.

13. The attachment system of claim 9 comprising:

a tab having a void center portion and a hook extending into said center portion for engaging said horizontal ladders.

14. An article to be secured to a ladder attachment system equipped apparatus comprising:

at least one tab having a semi-flexible body portion along a perimeter portion and attached to said article in a flexion area, each tab having a cut therein defining a locking hook enclosed by said body portion that can be flexed away from said tab for engaging said horizontal ladders.

* * * * *